US006688239B1

(12) United States Patent
Pettini et al.

(10) Patent No.: US 6,688,239 B1
(45) Date of Patent: Feb. 10, 2004

(54) HOLIDAY TREE DISPLAY TABLES

(76) Inventors: John R. Pettini, 4554 E. Paradise Village Pkwy. W. #213, Phoenix, AZ (US) 85032; Daniel C. Resanovich, 18891 N. 92nd Ave., Peoria, AZ (US) 85382

( * ) Notice: Subject to any disclaimer, the term of this patent is extended or adjusted under 35 U.S.C. 154(b) by 0 days.

(21) Appl. No.: 10/124,184

(22) Filed: Apr. 17, 2002

(51) Int. Cl.[7] ..... A47B 7/00

(52) U.S. Cl. ..... 108/50.11; 108/91; 108/92

(58) Field of Search ..... 108/50.11, 50.12, 108/59, 90, 91, 92, 101, 183, 190; 135/16; 211/188, 186

(56) References Cited

U.S. PATENT DOCUMENTS

| | | | | | |
|---|---|---|---|---|---|
| 116,459 | A | * | 6/1871 | Lee | 108/92 |
| 1,577,207 | A | * | 3/1926 | Diepernink-Langereis | 428/8 |
| 2,713,889 | A | * | 7/1955 | White | 297/158.3 |
| 3,180,288 | A | * | 4/1965 | McCowan | 108/101 |
| 3,405,895 | A | | 10/1968 | Perkins | |
| 3,674,612 | A | | 7/1972 | Gehl, Jr. | |
| 4,056,067 | A | * | 11/1977 | Steger | 108/101 |
| 4,345,526 | A | | 8/1982 | Streit | |
| 4,383,487 | A | | 5/1983 | Fitzner et al. | |
| D309,682 | S | * | 8/1990 | Fisher | D6/381 |
| 5,027,718 | A | * | 7/1991 | Graham, Sr. | 108/64 |
| 5,211,366 | A | | 5/1993 | Cummings | |
| 5,522,514 | A | | 6/1996 | Robinson | |
| 5,735,415 | A | | 4/1998 | Wilson | |
| 5,799,587 | A | * | 9/1998 | Branch | 108/66 |
| D414,056 | S | | 9/1999 | Palm et al. | |
| 6,155,529 | A | | 12/2000 | De Carlo | |
| 6,276,280 | B1 | | 8/2001 | Nitti | |
| 6,374,755 | B1 | * | 4/2002 | Haase et al. | 108/101 |

* cited by examiner

*Primary Examiner*—Lanna Mai
*Assistant Examiner*—Jerry A. Anderson
(74) *Attorney, Agent, or Firm*—Frank J. McGue

(57) ABSTRACT

A display unit is adapted to be mounted to a holiday tree. The display unit comprises a plurality of table tops, each of the table tops having an outer diameter which generally conforms to the cross sectional outer diameter of the holiday tree at differing heights. In addition, each of the table tops has a cutout where the trunk of a holiday tree extends through. Further, each of the table tops is divided into two portions along a join line extending through the cutout. The table tops are supported by legs extending between adjoining table tops and between the bottommost of the plurality of table tops and the ground.

20 Claims, 2 Drawing Sheets

HOLIDAY TREE DISPLAY TABLES

TECHNICAL FIELD

This invention relates in general to display tables, and, more particularly, to display tables associated with holiday trees.

BACKGROUND OF THE INVENTION

In recent years, a growing market has developed for collectable miniature villages which depict holiday scenes. To properly display such decorative scenes requires an ample amount of table or shelf space. In addition, other traditional holiday collectables including, but not limited to, nut crackers, figurines, nativities and toy trains also have display requirements that may tax the space available in both homes and retail stores.

In addition to table space requirements, it is aesthetically desirable to incorporate holiday collectable items with a holiday tree, either natural or artificial. In addition, to avoid damage to the tree itself, it is desirable that such any aesthetically pleasing display device not be attached to th trunk of the tree. At present, there exists no adaptable table-like fixture for use with a holiday tree for such purpose and with such limitation.

The present invention meets this need.

Table displays associated with trees or other vertical pole-like objects are known in the art.

U.S. Pat. No. 5,522,514 entitled "Modular Stacking Shelves for Umbrella Tables" which issued on Jun. 4, 1996 to Robinson discloses a modular stacking shelf system with split circular tops and center circular cutouts.

U.S. Pat. No. 6,276,280 entitled "Elevated Train Track Support Device" which issued on Aug. 21, 2001 to Nitti shows multi-level circular platforms and their support structures to be fitted around a Christmas tree to display toy trains.

U.S. Pat. No. 5,735,415 entitled "Christmas Tree with Shelving System" which issued on Apr. 7, 1998 to Wilson provides a Christmas tree shelf structure with shelf supports that attach to the tree trunk.

U.S. Pat. No. 6,155,529 entitled "Adjustable Christmas a Tree/Plant Stand" which issued on Dec. 5, 2000 to De Carlo shows an adjustable Christmas tree stand comprising a table with telescoping legs and a center cut out in the top for the tree trunk.

None of the references cited disclose the present invention.

SUMMARY OF THE INVENTION

It is an object of this invention to provide an aesthetically pleasing display unit for use with holiday trees.

It is a further object of this invention to provide an aesthetically pleasing display unit for use with holiday trees which is not affixed to the trunk of said trees.

Further objects and advantages of the invention will become apparent as the following description proceeds and the features of novelty which characterize this invention will be pointed out with particularity in the specification annexed hereto.

DESCRIPTION OF THE PREFERRED EMBODIMENT

Figure 1:
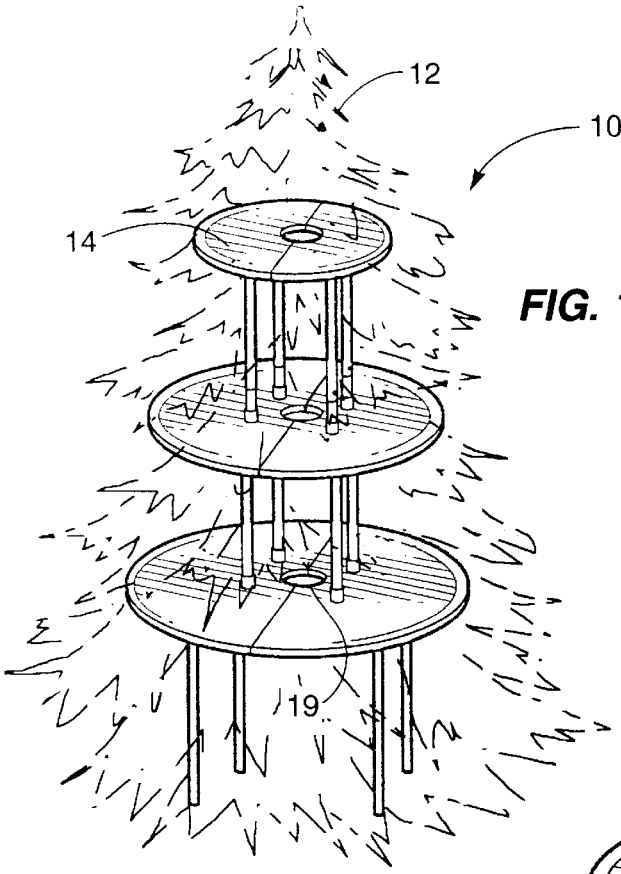
FIG. 1 is a perspective view of a display unit of the present invention on a holiday tree (in shadow)
Figure 2:
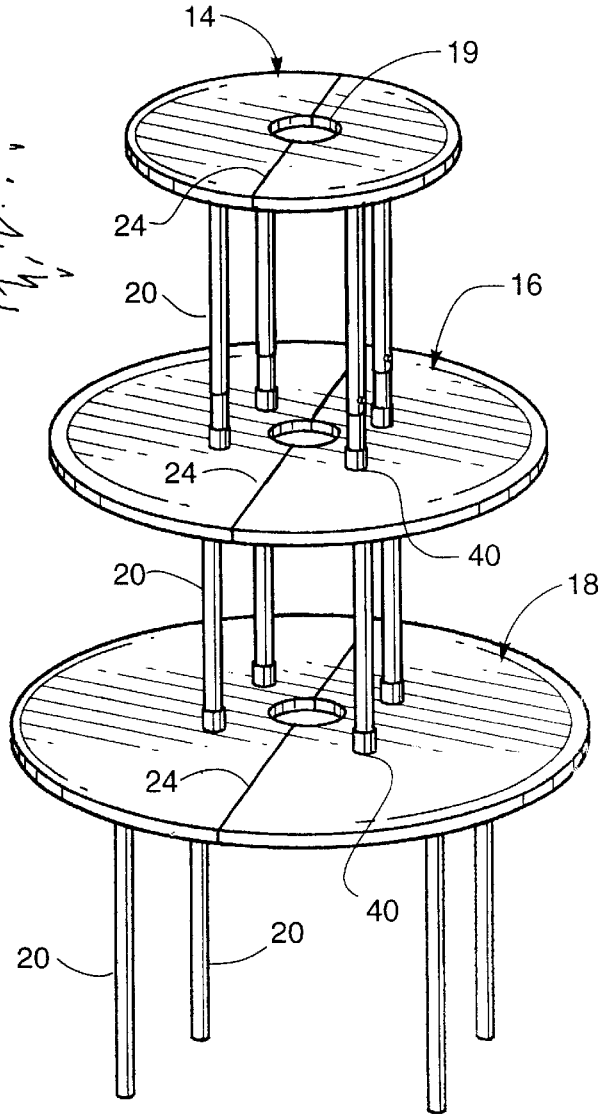
FIG. 2 is a perspective view of the display unit of FIG. 1 sans the holiday tree.

The present invention is shown in FIGS. 1–5 is a display unit 10 used in connection with a holiday tree 12. As best shown in FIG. 2, display unit 10 comprises an upper table top 14, a middle table top 16 and a base table top 18, each of said table tops resting upon four legs 20. As shown, table tops 14, 16 and 18 are circular have tapered diameters whereby each of said table tops is approximately equal to the cross sectional outer diameter of holiday tree 12 at the vertical position of each of said table tops. Thusly, display unit 10 is adapted to conform to the outline of holiday tree 12.

In addition, each table top 14, 16 and 18 includes a circular cutout 19 at the center of said table tops which is adapted to allow the trunk of tree 12 to extend therethrough.

In will be understood by those skilled in the art that the choice of three table tops 14, 16 and 18 in the present description is for exemplary purposes only and that the present invention is not meant to be limited to that number of table tops. The actual number of table tops employed is dependent upon the desired separation between adjoining table tops as well as the overall height of holiday tree 12.

Figure 3:
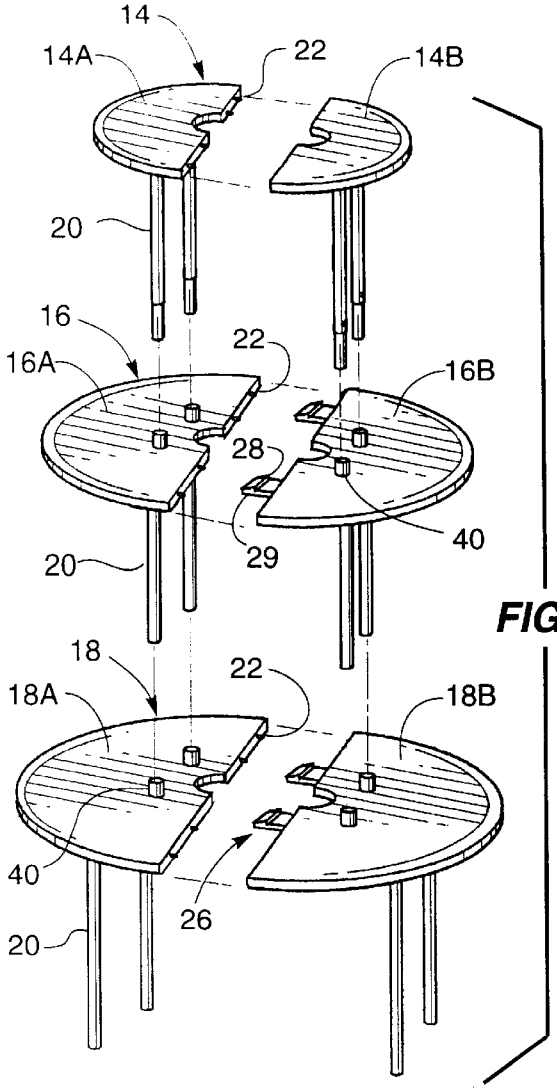
FIG. 3 is a perspective exploded view of the display unit of FIG. 2.

As best seen in FIG. 3, each table top 14, 16 and 18 is divided into two table top portions, 14*a* and 14*b*, 16*a* and 16*b*, 18*a* and 18*b*, by a join line 24 extending through cutout 19. As is well known in the art of joining tables, each table top portion 14*a*, 16*a* and 18*a* is provided with posts 22 which mate with corresponding holes (not shown) in table top portions 14*b*, 16*b* and 18*b* to properly align said portions.

Figure 4:
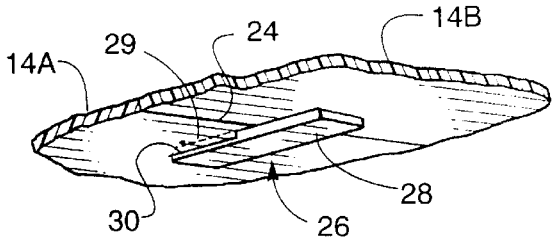
FIG. 4 is a perspective close up view of the snap on devices used to join two table halves.

As shown in FIG. 4, a pair of snap on clips 26 are provided along each join line 24 to firmly hold table top portions 14*a*, 16*a*, 18*a* to corresponding portions 14*b*, 16*b*, 18*b* together. Each clip 26 comprises an arm 28 having a clip 29 extending outwardly from portions 14*b*, 16*b* and 18*b* at join line 24 to mate with a corresponding slit 30 in the bottom of said opposing halve 14*a*, 16*a* and 18*a*, respectively.

Clips 19 and 30 are resiliently urged to mate, but are adapted to manually release from each other, to permit joining and separating said table tops 14, 16 and 18 as desired.

As shown in FIGS. 1–3, in the most preferred embodiment, to four legs 20 extend downwardly from each table top 14, 16 and 18 to engage table tops 16, 18 or the ground, respectively. Alternate embodiments may employ other numbers of legs 10, for example, three legs 20 in a tripod arrangement.

For stability, legs 20 extending downwardly from bottom table top 18 are preferably positioned at more distal radial distance from the trunk of tree 12.

The upper surface of table tops 16 and 18 are provided with cups 40 which mate with the downwardly extending legs 20 from table tops 14 and 16, respectively. The use of cups 40 is preferable to avoid having legs 20 slip on the upper surface.

Figure 6:
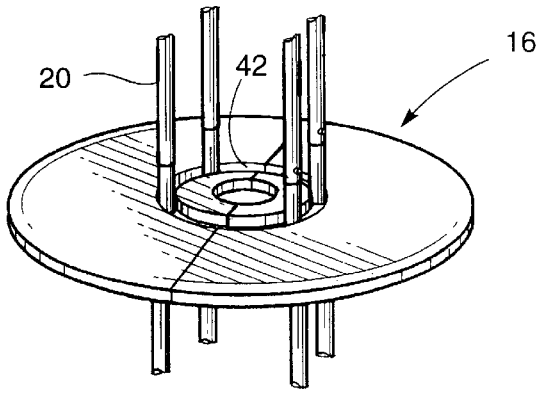
FIG. 6 is a close up perspective view of an alternate embodiment of the present invention.

In an alternate embodiment best seen in FIG. 6, a circular channel 42 is provided in the upper surface of table top 16 instead of cups 40. This embodiment allows for easy adjustment of the position of legs 20 to account for variations in the location of branches on tree 12.

One major feature of display unit 10 is that it supports itself via legs 20 as described independent of holiday tree 12. By supporting said invention by legs 20 rather than affixation to holiday tree 20, display unit 10 allows a substantial weight of objects to be displayed thereon without effecting the stability of holiday tree 12. In fact, display unit 10 stabilizes tree 12 in capturing the trunk of same within circular cutout 19.

Figure 5:
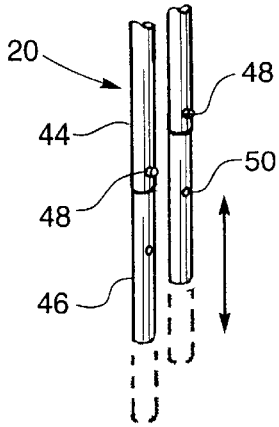
FIG. 5 is a close up view of telescoping legs of the present invention.

In another alternate embodiment best seen in FIG. 5, the length of legs 20 is adjustable by sliding an upper portion 44 telescopically within a lower portion 46. Push pins 48 are adapted to extend through corresponding holes 50 to hold legs 20 at a desired height. This allows a user to manually adjust the separation between table tops and the ground as desired.

Although only certain embodiments have been illustrated and described, it will be apparent to those skilled in the art that various changes and modifications may be made therein without departing from the spirit of the invention.

What is claimed is:

1. A display unit is adapted to be mounted around a holiday tree, the display unit comprising a plurality of table tops, each of the plurality of table tops having different outer diameters which diameters generally conforms to the cross sectional outer diameter of the holiday tree at a corresponding plurality of heights, each of the plurality of table tops having a cutout adapted to allow the trunk of a holiday tree extend therethrough, each of the plurality of table tops being divisible into two portions along a join line, the join line extending through the cutout, a first plurality of legs extending between adjacent table tops, and a second plurality of legs extending between a bottommost of the plurality of table tops and a support surface, the first and second plurality of legs supporting said plurality of table tops around the trunk of the tree and conforming to the shape of the tree, whereby the two portions of each table top are joined together along the join line to form one of the table tops with the trunk of the tree captured in the cutout.

2. The display unit of claim 1 wherein the cutout is circular.

3. The display unit of claim 1 wherein each of the table tops is circular.

4. The display unit of claim 1 wherein each of the legs is height adjustable.

5. The display unit of claim 4 wherein each of the legs is divided into an upper portion telescopically received within a lower portion to adjust the height thereof.

6. The display unit of claim 5 wherein push pins in the upper portion are adapted to extend through corresponding holes in the lower portion to hold legs at a desired height.

7. The display unit of claim 1 wherein the legs extend downwardly from each of the plurality of table tops.

8. The display unit of claim 7 wherein the legs extending downwardly from the bottommost table top are positioned at a more distal radial distance from the cutout than the legs between adjoining table tops.

9. The display unit of claim 7 wherein each plurality of legs is four legs.

10. The display unit of claim 7 wherein each plurality of legs is three legs.

11. The display unit of claim 7 wherein the upper surface of each table top is provided with a plurality of cups mating with and corresponding to the plurality of downwardly extending legs of the adjacent table top.

12. The display unit of claim 7 further comprising a recess in the upper surface of each of the plurality of table tops adapted to allow the plurality of downwardly extending legs from the adjacent table top to rest therein.

13. The display unit of claim 1 wherein each table top portion is provided with one or more posts which mate with corresponding holes in the corresponding table top portion to properly align said portions to form the table top.

14. The display unit of claim 13 further comprising snap on clips mounted along each join line to firmly hold table top portions together.

15. A display unit is adapted to be mounted around a holiday tree, the display unit comprising a plurality of table tops, each of the plurality of table tops having different outer diameters which diameters generally conform to the cross sectional outer diameter of the holiday tree at a corresponding plurality of heights, each of the plurality of table tops having a circular cutout adapted to allow the trunk of a holiday tree extend therethrough, each of the plurality of table tops being divisible into two portions along a join line, the join line extending through the cutout, first four height adjustable legs extending between adjacent table tops, and a second four height adjustable legs extending between the bottommost of the plurality of table tops and a support surface, the second four height adjustable legs being positioned at a more distal radial distance from the cutout than any first four height adjustable legs, the first and second plurality of height adjustable legs supporting said plurality of table tops around the trunk of the tree and conforming to the shape of the tree, whereby the two portions of each table top are joined together along the join line to form one of the table tops with the trunk of the tree captured in the circular cutout.

16. The display unit of claim 15 wherein each of the legs is divided into an upper portion telescopically received within a lower portion to adjust the height thereof.

17. The display unit of claim 16 wherein push pins in the upper portion are adapted to extend through corresponding holes in the lower portion to hold legs at a desired height.

18. The display unit of claim 15 wherein the upper surface of each table top is provided with a plurality of cups mating with and corresponding to the plurality of downwardly extending legs of the adjacent table top.

19. The display unit of claim 15 further comprising a recess in the upper surface of each of the plurality of table tops adapted to allow the plurality of downwardly extending legs from the adjacent table top to rest therein.

20. The display unit of claim 15 wherein each table top portion is provided with one or more posts which mate with corresponding holes in the corresponding table top portion to properly align said portions to form the table top and snap on clips are mounted along each join line to firmly hold the mating table top portions together.

* * * * *